United States Patent [19]

Craig et al.

[11] Patent Number: 4,610,636

[45] Date of Patent: Sep. 9, 1986

[54] FRAME CENTERING APPARATUS

[75] Inventors: Daniel E. Craig, Marion; Clarence E. Walker, Jr., Anderson, both of Ind.; Leonard P. Wilbur, Jr., Lancaster, Pa.

[73] Assignee: RCA Corporation, Princeton, N.J.

[21] Appl. No.: 736,824

[22] Filed: May 22, 1985

[51] Int. Cl.[4] ..... H01J 9/00

[52] U.S. Cl. ..... 445/68; 29/281.5; 228/49.1

[58] Field of Search ..... 445/68, 30, 45; 29/760, 29/281.5; 228/212, 49.1

[56] References Cited

U.S. PATENT DOCUMENTS 3,381,347 5/1968 Reinwall ..... 445/45 X 3,668,362 6/1972 Kirchner ..... 445/68 X

FOREIGN PATENT DOCUMENTS 1080 1/1980 Japan ..... 445/30

*Primary Examiner*—Kenneth J. Ramsey

*Attorney, Agent, or Firm*—E. M. Whitacre; D. H. Irlbeck; L. L. Hallacher

[57] ABSTRACT

An apparatus for centering a shadow mask frame in a faceplate panel includes a fixed plate and a slidable plate. A set of blades is rotatably mounted in the fixed plate. The blades are coupled to the slidable plate by coupling members whereby motion between the plates simultaneously rotates the blades. The blades extend into a space between the frame and the panel and urge the frame into a centered orientation in the panel.

6 Claims, 6 Drawing Figures

FRAME CENTERING APPARATUS

BACKGROUND

This invention relates generally to an apparatus for centering one object within another object and particularly to an apparatus for centering a shadow mask frame in a kinescope faceplate panel.

A color picture tube includes a color selection electrode, commonly called a shadow mask, which causes the electron beams to impact phosphors of the proper light emitting color. Shadow masks are fabricated from thin conductive metal and include a large plurality of apertures and, accordingly, are flimsy and easily deformed. The shadow mask, therefore, is welded to a sturdy frame which lends physical support to the mask. Apertured support springs are welded to the sides of the frame. The apertures in the springs engage studs, which are embedded in the sidewalls of the glass faceplate panel, to support the mask within the panel. The black matrix and phosphor lines of which the screen is composed are formed by coating the inside surface of the panel with slurries of phosphor materials and exposing the slurries to light through the shadow mask apertures. Typically the apertures are rectangular with the long side arranged parallel to the direction of the phosphor and matrix lines. The screen lines are formed by moving the mask in the direction of the screen lines as the light passes through the apertures. The springs support the mask and frame in the panel in the orientation which existed when the springs were welded onto the frame. Accordingly, it is essential that the shadow mask frame be centered and properly oriented with respect to the faceplate panel while the springs are welded to the frame. For these reasons, there is a need for an apparatus for accurately centering, orienting and holding a shadow mask frame within a kinescope faceplate panel while the support springs are welded to the frame. The present invention fulfills this need.

SUMMARY

An apparatus for centering a frame in a similarly configured object whereby a space exists between the outer periphery of the frame and the inside border of the object includes a fixed plate having a plurality of rotatably mounted blades spaced to enter the space on all sides of the object. Each of the blades includes a coupling means. A movable plate is substantially parallel to the fixed plate and slideably engages the coupling means. When the movable plate is moved the blades are rotated by the coupling means to engage the frame and object and urge the frame into a centered position within the object.

DETAILED DESCRIPTION

Figure 1:
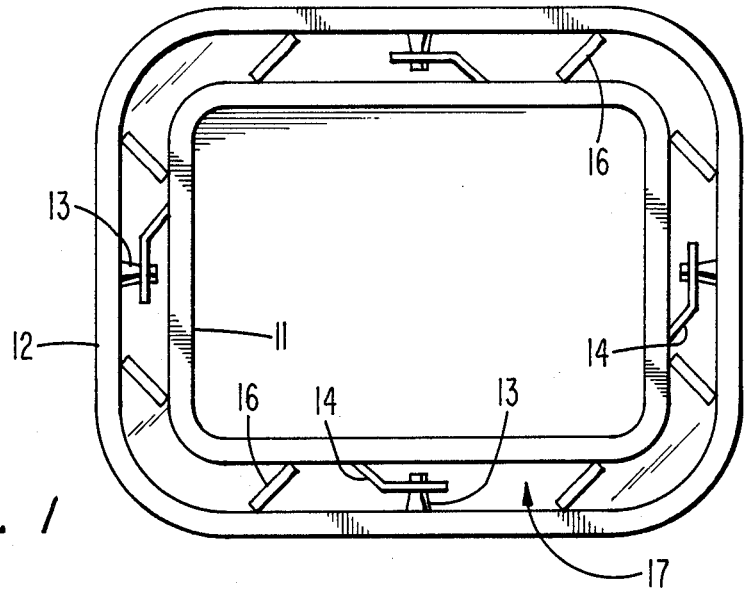
FIG. 1 shows a shadow mask frame centered within a faceplate panel.

In FIG. 1, a shadow mask frame 11 is arranged within a glass faceplate panel 12 for a color kinescope. A phosphor screen (not shown) is arranged on the inside surface of the panel 12. An apertured shadow mask (not shown) will be welded to the frame 11 in a subsequent processing step. In the operation of a kinescope, electron beams pass through the apertures within the shadow mask and impact the phosphor lines on the panel to emit the various colors of light to form a colored visual display on the tube. Accordingly, it is critical for the frame 11 to be properly centered and oriented within the faceplate panel 12 during the production of the phosphor screen and during the operation of the tube.

A plurality of studs 13 are embedded in the sidewalls of the faceplate panel 12 and are used to support the frame 11 within the panel. A plurality of leaf springs 14 are subsequently welded to the frame 11 and include apertures which engage the studs 13. A plurality of rotatable blades 16 is arranged in the space 17 between the frame 11 and panel 12. The blades 16 are rectangular and the largest dimension is greater than the dimension of the space 17.

When using the invention a frame 11 is placed into the panel 12 and the frame usually is not centered within the panel, and the sides of the frame usually are not parallel to the sides of the panel 12. The springs 14 are placed on the studs while they are still separated from the frame 11. The blades 16 are brought in the space 17 between the frame 11 and the panel 12 and the blades 16 are rotated such that the largest dimension of the blades is substantially parallel to the sides of the panel. The blades 16 are simultaneously rotated to urge the frame 11 into a position which is centered within the panel 12 and oriented such that the sides of the frame are substantially parallel to the sides of the panel. The springs 14 are then welded to the frame 11 while the blades 16 hold the frame 11 and panel 12 in the desired centered orientation.

Figure 2:
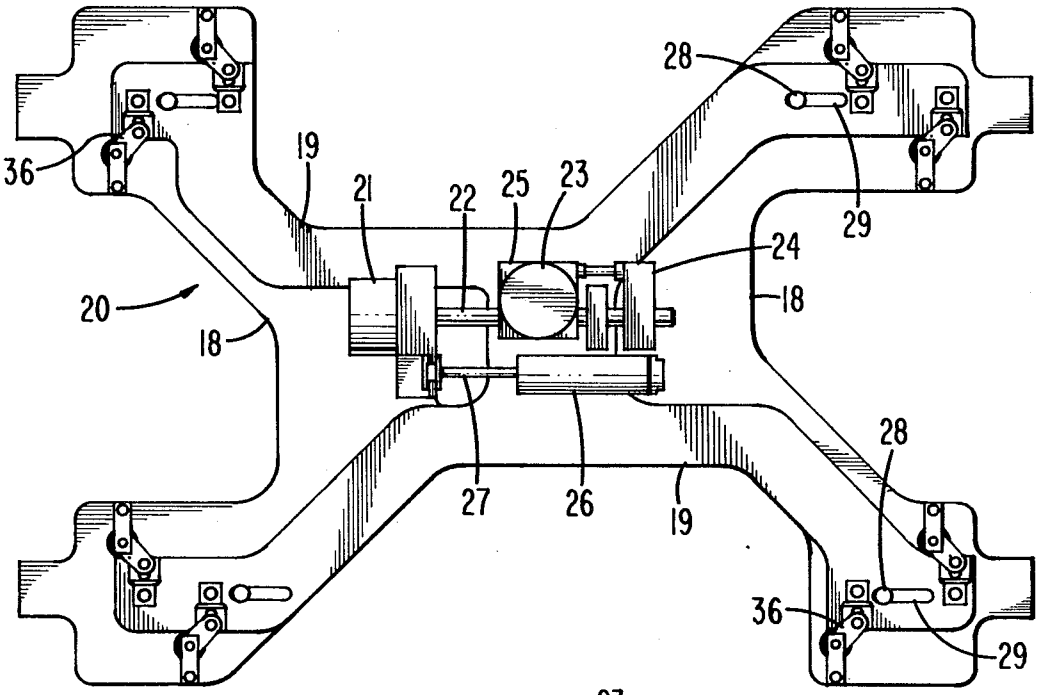
FIG. 2 is a bottom view of a preferred embodiment.
Figure 3:
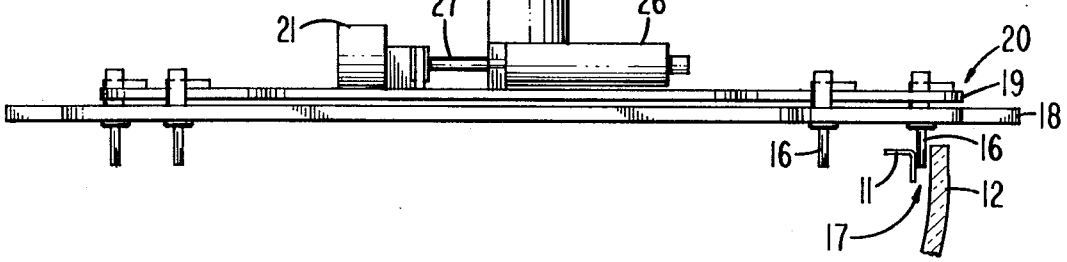
FIG. 3 is a side view of the preferred embodiment.

In FIGS. 2 and 3 the frame centering apparatus 20 includes a fixed plate 18 and a movable plate 19 arranged substantially parallel to the fixed plate 18. A cylinder 21, having a shaft 22, is attached to the fixed plate 18. The shaft 22 passes through a base 25 which supports another cylinder 23. The shaft 22 is slideable within a guide block 24 which is permanently affixed to the fixed plate 18. A second cylinder 26 is permanently affixed to the movable plate 19, and has a shaft 27 attached to the first cylinder 21. Guide pins 28 are permanently set into the fixed plate 18. Slots 29 are formed in the movable plate 19 and engage the pins 28. Accordingly, upon actuation of the cylinder 26, the movable plate 19 slides along the fixed plate 18 and the guide pins 28 and slots 29 serve to constrain the motion to a linear sliding motion between the plates.

Figure 4:
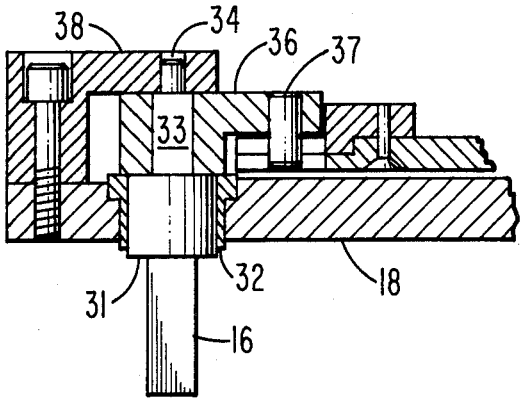
FIG. 4 is a cross sectional detailed view of the orienting blade mounting.

In FIG. 4, the rectangular blade 16 is integral with a clyindrical bearing surface 31 which is rotatably mounted in the fixed plate 18 by a bushing 32. If desired the blade 16 can be pivotable with respect to the bearing surface 31 to decrease the tolerance required to have the blades enter the space 17. A square portion 33 of the blade 16 is integral with the bearing surface 31 and a guide pin 34 is integral with the square portion 33. A crank arm 36 includes a square hole to snugly engage the square portion 33 of the blade 16, and carries a slide pin 37. An L-shaped support member 38 includes an aperture which rotatably receives the guidepin 34. The L-shaped support member is affixed to the fixed plate 18 to stabilize the blade 16 and its associated integral parts in the desired vertical orientation. As shown in FIG. 2, there are two of the crank arms 36 arranged at each of the four corners of the apparatus 20.

Figure 6:
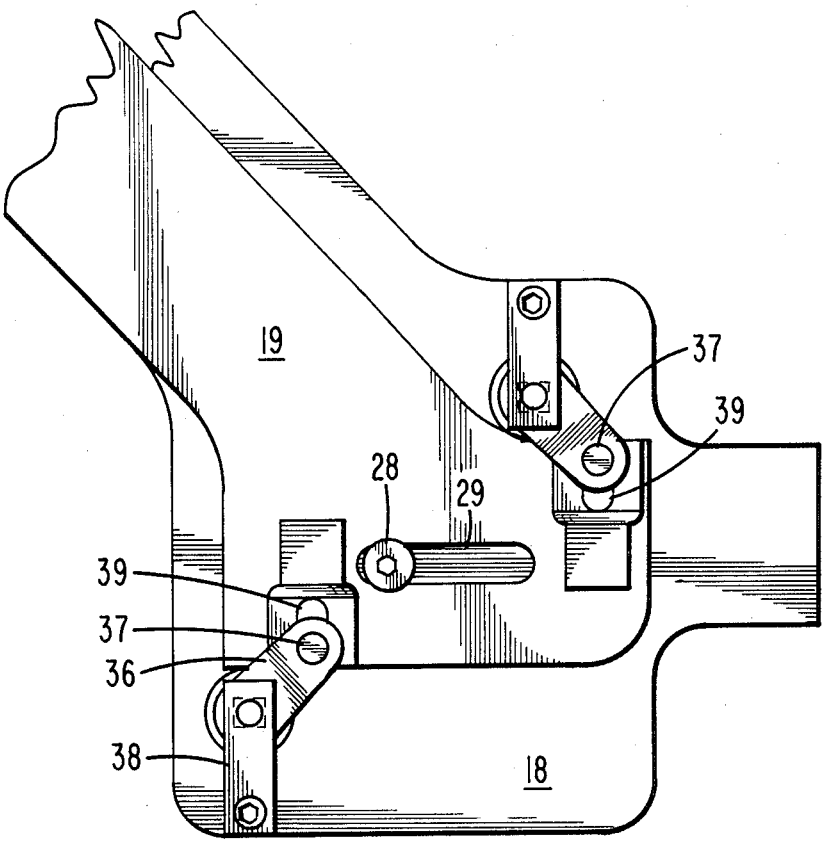
FIG. 6 shows the coupling of the crank arms to the fixed and movable plates in detail.

In FIG. 6, the slideable plate 19 includes additional slots 39 which engages the pins 37. Accordingly, the pins 37 and the crank arms 36 serve to rotatably couple the movable plate 19 with the blades 16. When the movable plate 19 is actuated by the cylinder 26, the sides of the slots 39 engage the pins 37 and simultaneously rotate all the crank arms 36. The square portions 33 of the blades 16 assure rotation of the pins 16 into engagement with the frame 11 to urge the frame into a centered position and orientation with respect to the panel 12. During the rotation of the crank arm 36, the pins 37 slide in the slots 39 and accordingly the slots have a depth which is sufficient to accommodate up to a 90° rotation of the blade 16.

Figure 5:
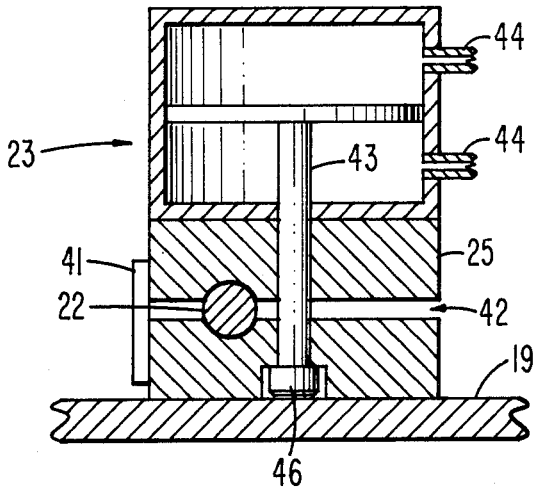
FIG. 5 is a cross sectional view of the clamping mechanism.

FIG. 5 is a cross sectional view of the cylinder 23. The cylinder 23 is mounted on the base 25 which includes a slot 42. The cylinder 23 is coupled to a fluid or air source (not shown) by tubulations 44. The cylinder 23 is attached to the base 25 and the shaft 43 is coupled through the base 25 by a bolt 46. The shaft 22 of the cylinder 21 passes through an aperture within the base 25 as shown. A hinge 41 is arranged on the base 25 to permit the base 25 to flex and clamp onto the shaft 22 when the cylinder 23 is actuated.

In operation, when the blades 16 enter the space 17 between the frame 11 and panel 12, the longest dimension of the rectangular blade 16 is substantially parallel to the sides of the frame and panel. The cylinder 26 is actuated to move the movable plate 19 in a linear fashion. The slots 29 in the movable plate 19 slide on guide pins 28 to assure linear motion. The sliding movement causes the slots 39 in the slideable plate 19 to engage the pins 37 mounted in the crank arms 36 to rotate the crank arms to simultaneously rotate the blades 16. The sliding motion continues as all eight of the blades 16 simultaneously rotate to urge the frame into a centered position with respect to the faceplate 12. When the frame 11 is centered, the blades 16 are jammed in the space 17 between the frame and the panel and this jamming causes cessation of the motion of the cylinder 26. The cylinder 23 is actuated to flex the base 25 and clamp onto the shaft 22. The cylinder 21 is extended a very slight distance to move the slideable plate 19 backwardly in the opposite direction from which the initial motion occurred. The backup motion is used to relieve any stresses in the frame 11 and panel 12 caused by the jamming of the blades 16 against these two objects. The slot 42 and hinge 41 permit the base 25 to flex and decrease the slot 42 to pinch the base 25 snuggly against the shaft 22 of the cylinder 21 and fixedly maintain the relative position of the plates 18 and 19. The guide block 24 serves to stabilize the free end of the shaft 22. The springs 14 are then welded to the frame 11 with the frame 11 very accurately centered in the faceplate 12 and with the sides of the frame and faceplate substantially parallel. After the springs are welded to the frame, the cylinders are deactuated to return the apparatus 20 to the neutral position ready for the reception of another frame and panel assembly.

What is claimed is:

1. Apparatus for centering a frame in an object, said frame and said object being similarly configured whereby a space exists between the outer periphery of said frame and the inside border of said object, said apparatus comprising:

a fixed plate; a plurality of substantially rectangular blades rotatably mounted in said fixed plate, the largest dimension of said blades exceeding the width of said space said blades being spaced about said fixed plate whereby said blades enter said space on all sides of said object, each of said blades including coupling means a movable plate arranged substantially parallel to said fixed plate, said movable plate slideably engaging said coupling means; and means for moving said movable plate whereby said blades are rotated by said coupling means to engage said frame and said object and urge said frame into a centered position within said object.

2. The apparatus of claim 1 wherein said movable plate slides with respect to said fixed plate, and further including guide means for confining said sliding to a straight motion.

3. The apparatus of claim 2 wherein said means for moving is a first cylinder whereby said cylinder slides said movable plate until said blades jam between said frame and said object, and further including an additional means for moving, said additional means for moving slightly sliding said movable member in a direction opposite to the direction of the intial movement to relieve stresses caused by said jamming.

4. The apparatus of claim 3 wherein said first cylinder includes a shaft, and further including clamp means arranged to firmly engage said shaft to retain said blades in the desired orientation.

5. The apparatus of claim 4 wherein said coupling means include crank arms and guide pins, and wherein said movable plate includes slots for engaging said guide pins.

6. The apparatus of claim 5 wherein said frame is a shadow mask frame for a color television picture tube and said object is a faceplate panel for such a tube, and wherein at least two of said blades is arranged to engage each side of said frame.

* * * * *